United States Patent [19]

Chappoux et al.

[11] Patent Number: 4,840,264

[45] Date of Patent: Jun. 20, 1989

[54] DEPOSIT SYSTEM INSTALLATION FOR TROLLEYS

[75] Inventors: Claude Chappoux, Mornant; Bernard Rouesnel, Ecully; Guy Gillet, Deols, all of France

[73] Assignees: Ronis S.A.; Super Market Systems, both of France

[21] Appl. No.: 79,796

[22] Filed: Jul. 30, 1987

[30] Foreign Application Priority Data

Aug. 4, 1986 [FR] France ..... 86 11255
Feb. 17, 1987 [FR] France ..... 87 01992

[51] Int. Cl.[4] ..... G07F 7/00

[52] U.S. Cl. ..... 194/212; 194/250; 194/258; 194/905

[58] Field of Search ..... 194/205, 212, 905, 258, 194/250, 255, 234

[56] References Cited

U.S. PATENT DOCUMENTS 1,093,175 4/1914 Fransworth ..... 194/250
1,105,052 7/1914 Williams ..... 194/258
2,748,915 6/1956 Byrnes ..... 194/234

FOREIGN PATENT DOCUMENTS

84/04835 12/1984 World Int. Prop. O. ..... 194/905
WO/04174 7/1986 World Int. Prop. O. ..... 194/905

*Primary Examiner*—F. J. Bartuska
*Attorney, Agent, or Firm*—James Creighton Wray

[57] ABSTRACT

The invention relates to a deposit system installation for transport trolleys. This deposit system comprises a locking line constituted by a substantially horizontal bar and deposit system apparatuses which are connected to the trolleys, whereby there is cooperation of longitudinal sliding within the line. Each deposit system apparatus comprises a coin system arranged to permit the separation of the apparatus from the locking line by the introduction of a deposition such as a coin into the apparatus. This deposit may then be liberated by the passage of the apparatus over a decoding station which is part of the locking line.

8 Claims, 4 Drawing Sheets

DEPOSIT SYSTEM INSTALLATION FOR TROLLEYS

The invention relates to a deposit system installation for transport trolleys such as those used in commercial premises, railway stations, airports, etc.

BACKGROUND TO THE INVENTION

The organisation of the use of such trolleys encounters the necessity of creating lines of trolleys available for users at specific positions. To this end it is usual to provide men on duty entrusted with collecting the abandoned trolleys after use and bringing them to these positions. This organisation is costly and further leaves trolleys abandoned for a certain time at positions, especially car parks and garages, where they are in danger of being damaged and causing accidents.

To diminish this drawback it has been proposed to subject the use of such trolleys to a deposit system, the liberation of a trolley being obtained by introduction of a deposit, generally a coin, which is returned only by the return of the trolley to the positions intended for this purpose.

STATEMENT OF PRIOR ART

U.S. Pat. No. 2,753,970 provides for example for this purpose an installation comprising individual trolley reception stations with a coin lock for each of the stations. Such an installation is extremely costly and presents the major drawback of occupying a very large space in as much as the trolleys are stored separately from one another.

French Pat. Nos. 74.02158 published under 2,257,965 provides a locking system liberated by a coin mechanism for the taking of a trolley and a system for restoration of at least a part of the deposit including a projecting device actuated at the time of the restoration. Such an installation is likewise costly and furthermore not very reliable in operation since, as in the previous case, the deposit is retained at the collecting station where it can easily be regained without the trolley itself.

In French Pat. Nos. 76.36704 published under 2,333,687 a deposit apparatus has been proposed carried by each trolley and comprising a male part and a female part, co-operating with the complementary part of the deposit device of another trolley in order to lock trolleys together in interengaging lines from a station head equipped with a male or female part for reception of a complementary part of the deposit device of a first trolley.

This last device, which has been subjected to significant industrial developments, does however present numerous drawbacks. When the deposit apparatus is in one single piece, its positioning is delicate and generally it protrudes laterally from the trolley, the bulk of which is thus increased. If the male part and the female part are separated, one of these being fixed to the trolley by a flexible connection such as a chain, the problems of positioning and bulk can be simplified but the handling of the device is rendered complicated and its price is increased. In both cases the device has the advantage that the deposit is attached to the trolley but offers the grave drawback of not permitting, in a simple manner, of limiting the length of the constituted trolley lines.

OBJECT OF THE INVENTION

The present invention aims at eliminating the drawbacks of the known installations and devices by means of a new installation in which the deposit remains attached to the trolley and the length of the trolley lines is limited, the whole being of low cost price, easy and flexible installation and reliable operation.

SUMMARY OF THE INVENTION

To this end the installation according to the invention is characterised in that it comprises a locking line constituted by a substantially horizontal bar with which there can co-operate deposit system apparatuses each connected to a trolley, each deposit system apparatus comprising a coin system arranged to permit the separation of an apparatus from the said locking line by the introduction of a deposit such as a coin into the said apparatus, the liberation of the said deposit being produced by the passing of the said apparatus over a de-coding station which forms part of the locking line.

The capacity of the installation is limited by the length of the locking line, the sliding of the deposit system apparatuses on the bar ensuring the ordered arrangement of the trolleys.

BRIEF DESCRIPTION OF DRAWINGS

The invention will be clearly understood on reading of the following description given with reference to the accompanying drawing, wherein.

DESCRIPTION OF PREFERRED EMBODIMENT

Figure 1:
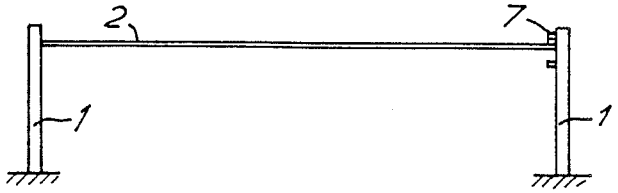
FIG. 1 is a diagram of an installation according to one example of embodiment of the invention.
Figure 2:
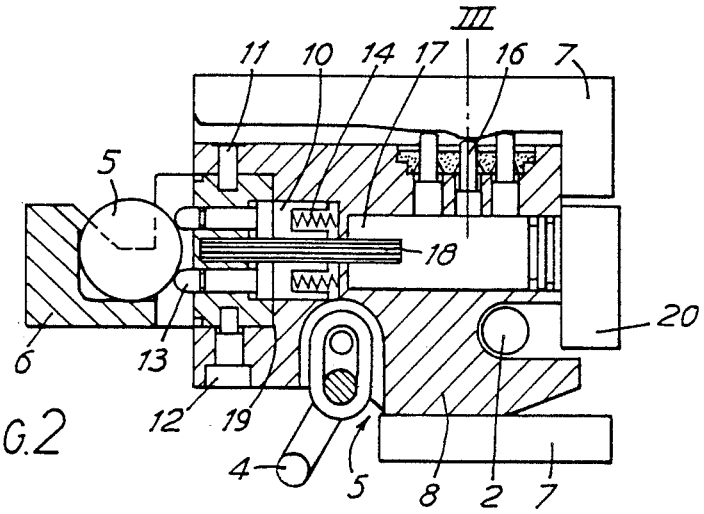
FIG. 2 is a diagrammatic sectional view of a deposit system apparatus on a de-coding station of the installation according to FIG. 1.

Reference will be made first of all to FIGS. 1 to 6 which represent a first form of embodiment of an installation according to the invention.

In the storage area two posts 1 are fixed to the ground and connected by a bar 2. Deposit system apparatuses 3 connected to the trolleys by chains 4 are locked to this bar. The introduction of the correct coin 5 into the apparatus permits of turning a knob 6 which liberates the apparatus from the bar, in order to permit the use of the trolley. The knob is locked in this position preventing the withdrawal of the coin. It is only on return, when the apparatus has been placed on a coder (key) 7 that the rotation can take place (in the converse direction), at the end of which rotation the coin can be taken out again.

The deposit system device 3 is composed of a body 8 on which there is fixed a chain 4 for connection with the trolley. On the body 8 a knob 6 is rotatingly mounted retained on the body 8 by elements 11 and 12. The knob 6 comprises pistons 13 thrust axially by the coin 5 and co-operating with push members 10 themselves moved by springs 14. The knob 6 is connected in rotation with a rotor 17 which through a profiled section 18, itself comprises push members 15 pushed by springs 15', which push members 15 co-operating with pistons 16, effect either the locking or the rotation of the rotor 17. At its extremity the rotor 17 possesses a cam 20 which permits of locking the apparatus on a bar.

Figure 3:
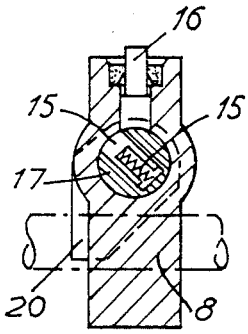
FIG. 3 is a sectional view of the deposit system apparatus along the line III in FIG. 2, in the unlocking position.

When the apparatus is at rest, locked on the bar 2, the push members 10 lodged in the body 8 ensure, by means of the springs 14, the locking in rotation of the knob 6 and thus of the rotor 17. The push members 15 are then "in readiness" (FIG. 3). The introduction of the correct coin 5 permits of aligning the pistons 13 with the plane 19 (body-knob). The rotation can then be effected in such manner that the cam 20 fast with the rotor 17 will permit of withdrawing the apparatus from the bar 2.

Figure 4:
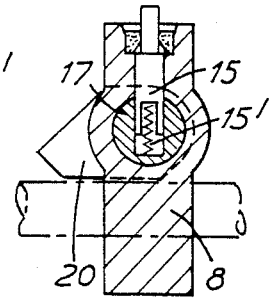
FIG. 4 is analogous with FIG. 3 for the locking position.
Figure 6:
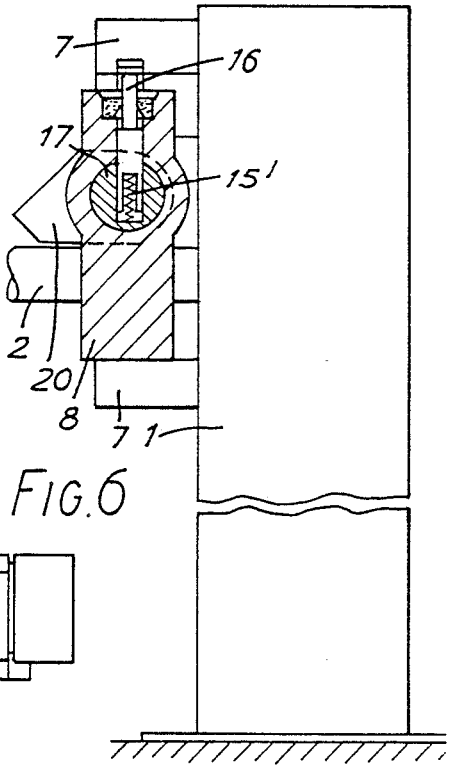
FIG. 6 is a view in elevation of the de-coding station with a deposit system apparatus, seen in section.
Figure 5:
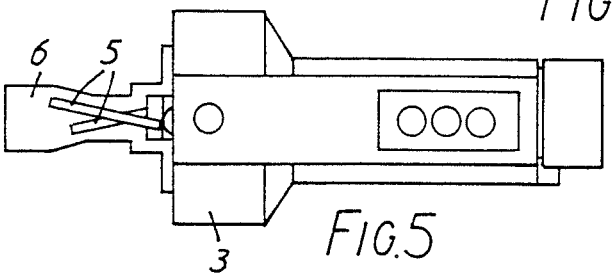
FIG. 5 is a plan view of the deposit system apparatus according to FIGS. 3 and 4.
Figure 7:
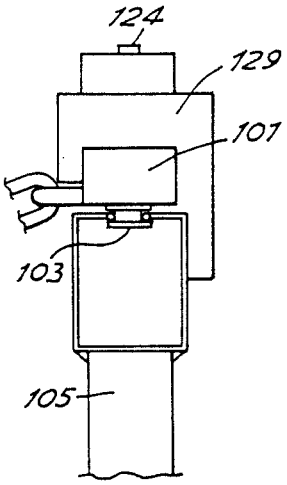
FIG. 7 is a view in elevation, partially in section, of a deposit system apparatus sliding on a bar of an installation according to a variant of the invention.
Figure 10:
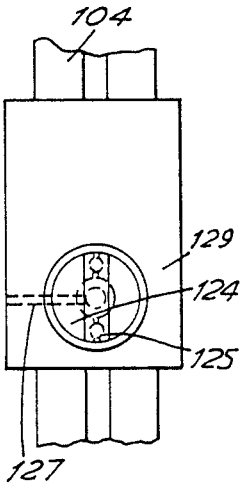
FIG. 10 is a plan view of an apparatus beneath the monitor head.

Having arrived in this position, the pistons 15 by means of the springs 15' lock the rotor 17 and thus the knob 6, by penetrating into the body 8 (FIG. 4). The apparatus is then unhooked from the bar 2, the trolley can be used by the customer, the coin is locked within the knob 6 and the pistons 13 cannot retract, being pressed on the plane 19.

In order to recover the coin on return the user must place the apparatus in position on the coder 7 fixed on a post 1, which coder is fixed at a position such that when the rotation of the knob 6 in the opposite direction can be effected, the device will again be locked on the bar 2.

The coder 7 possesses a key-forming part which permits of effecting the alignment of the pistons 16 (which can be of different lengths) with the diameter of the rotor 17, permitting rotation of the latter and thus of the knob 6. When rotation is effected the taking of the coin is possible.

The withdrawal of the coin having been effected, the knob 6 is again locked.

The apparatus can be arranged to co-operate with a hollow C-shaped section (instead of a cylindrical bar as in the case of the drawing). The device would present on its body, a rectangular form permitting sliding and not a rotating movement (in relation to the profiled section) and the extremity of the rotor would present a likewise rectangular form which would be superimposed upon the form of the body, after rotation (unlocking with a coin), the super position of these two forms permitting the withdrawal of the apparatus from the profiled section. The de-coding system would then be placed at the end in such manner that the rotor can turn only when its rectangular form is within the profiled section.

It should be noted that the knob 6 possesses two lodgements of different dimensions, which lodgements are capable of receiving coins of different dimensions, but the fact that they are intersecting permits of using only one coin after the other.

Reference will now be made to FIGS. 7 to 10 which represent a variant of the installation according to the invention.

The coin deposit system 101 is connected definitively by a flexible connection 102 to the trolley. The apparatus comprises two T-shaped elements 103 permitting it to slide on a C-shaped section 104, without possibility of it being withdrawn therefrom except at one of the extremities, and this in the case when the correct coin has been introduced. The profiled section 104 is itself supported by stakes 105 sealed in the ground.

The apparatus 101 is composed of a body, and an interchangeable element 107, capable of receiving two coins 110 and 111 (or only one) possibly of different diameters and thicknesses, in its lodgements 108 and 109. This interchangeable element possesses a latch 112 capable of oscillating about a spindle 113, the extremity 114 of which latch is held pressing upon the introduced coins, by a spring 115 preventing these coins from falling, which could take place during displacements of the apparatus 101 on the profiled section 104.

A bolt 116 is mounted for sliding in the body of the apparatus 101 and is moved by a rotor 117 which comprises an eccentric capable of rotating through 180°, the rotor 117 possessing on its periphery two diametrically opposite hollow V-forms which co-operate with a leaf spring 118 to ensure indexing of the rotor 117 in each of its two positions. A boss formed on the bolt 116 prevents the oscillating movement of the latch 112 in the position when the apparatus is removed from the bar (trolley in service, coin locked) as in the lower part of FIG. 8.

The profiled section 104 supports a monitor head 129 fixed close to one of the extremities, which monitor head possesses a passage permitting of letting the body of the apparatus 101 pass.

Figure 8:
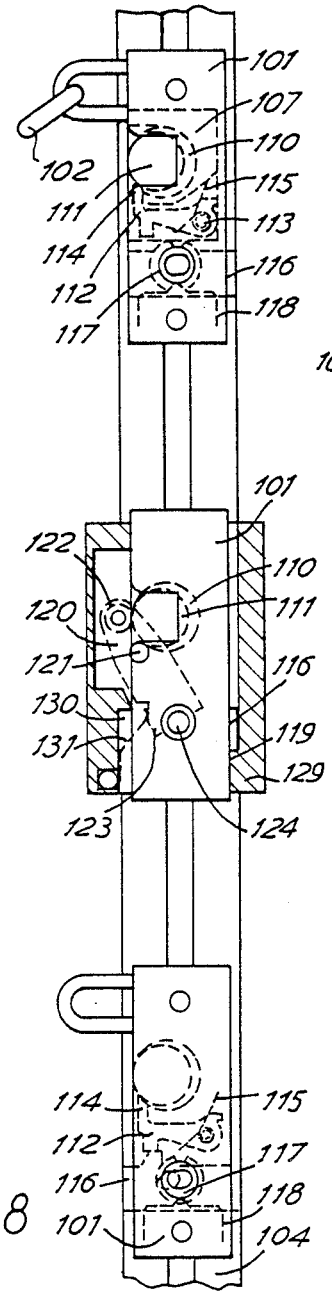
FIG. 8 is a view of the installation according to FIG. 7 in plan view, partially in section, representing at the top an apparatus into which a coin has been introduced, in the middle an apparatus introduced beneath a monitor head and, at the bottom, an apparatus locked on the bar.
Figure 9:
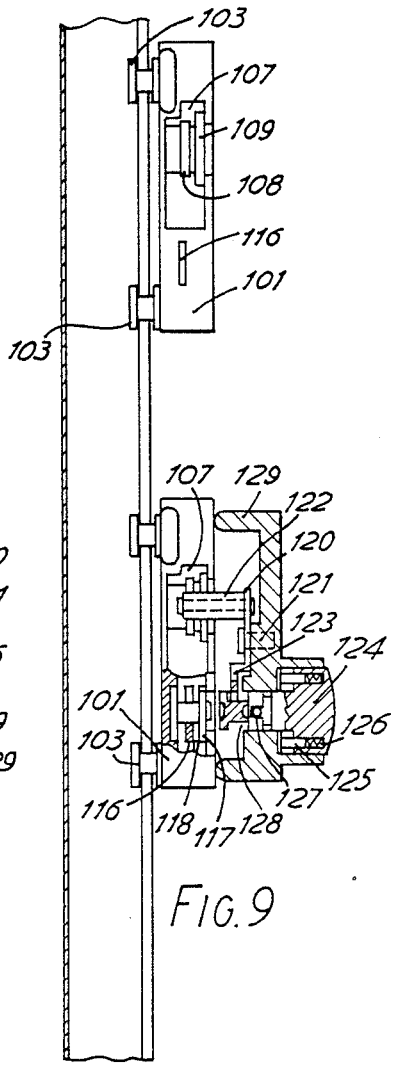
FIG. 9 is a view in lateral elevation of the installation according to FIG. 8 with, at the top, a deposit system apparatus with an introduced coin and at the bottom, partially in section, the apparatus beneath the monitor head.

The upper part of FIG. 8 represents an apparatus into which a correct coin (or the other coin) has been introduced. This apparatus can penetrate beneath the monitor head 129 until the extremity of the bolt 116 abuts on a stop 119 of the head 129. In this position a fork 120 oscillating about a spindle 121 and comprising a roller 122 is held pressing upon the coin contained in the apparatus 101 by a spring 191. If the coin contained in the apparatus 101 is of the intended diameter, the extremity 123 of the fork 120 is aligned with the cylindrical extremity of a knob 124 mounted on the monitor head 129, which knob cylindrical extremity possesses a groove in which the extremity 123 of the fork 120 can lodge in the case where the coin is absent or of too small a diameter. The extremity of the knob 124 further possesses a hollow elliptical form capable of fitting over an identical but relief form which is part of the rotor 117. The knob 124 is constantly urged upwards by catches 125 the conical extremity of which co-operates with hollow V-forms formed on the head 129, which catches ensure the indexing of the knob 124 at each half turn, while a pin 127 co-operates with two channels connected to a circular groove 128 to ensure the immobilisation of the knob 124 in rotation, when it has not been possible to push the latter in (coin absent in the apparatus 101 or too small).

If the correct coin has been placed in the apparatus it is possible to press in the knob 124; simultaneously the elliptical imprints of the extremity of the knob 124 and of the rotor 117 will mesh and the pin 127 will be aligned with the circular groove 128 of the knob 124, which then must be turned through 180°, the re-ascent of the knob 124 being effected when the catches 125 have again indexed it and in parallel one of the channels of the knob 124 is aligned with the pin 127 fast with the head 129. The rotor 117 having turned through 180°, it is the other extremity of the bolt 116 which will emerge from the apparatus 101 in a channel formed on the head 129. The rotation of the bolt has then authorised the removal of the apparatus 101, the latter can then be withdrawn from the profiled section 104, the coin being blocked by the latch 112.

On return of the trolley the converse operation will be effected, namely: Positioning of the apparatus 101 on the profile 104; introduction, by pushing the trolley, of the apparatus 101 beneath the monitor head 129 (the bolt will abut on the extremity of the channel 30); pressing and rotation of the knob 124; withdrawal of the monitor head 129 and recovery of the coin.

With the installation according to the invention it is possible to store in line not only trolleys of equal capacity but also trolleys of different capacities provided that the code of the deposit system apparatuses is identical.

Reference will now be made to FIGS. 11 to 21 which describe a variant of the invention.

Figure 11:
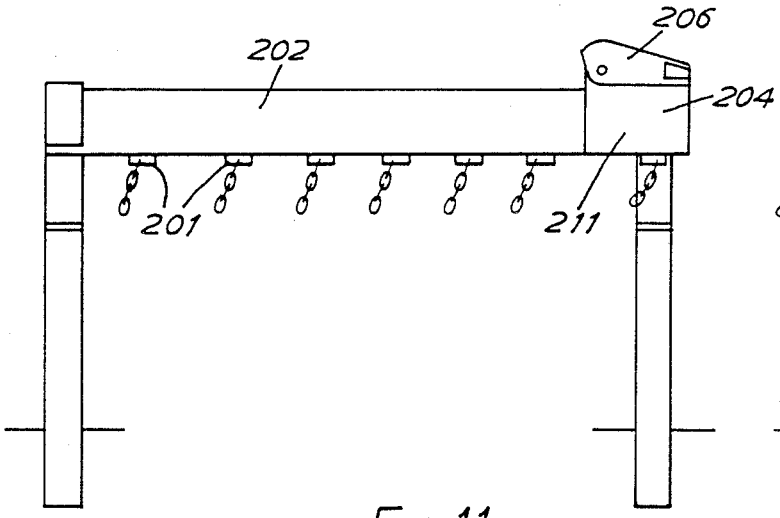
FIG. 11 is a lateral elevational view of an installation according to a variant of embodiment of the invention, trolleys not being represented.
Figure 12:
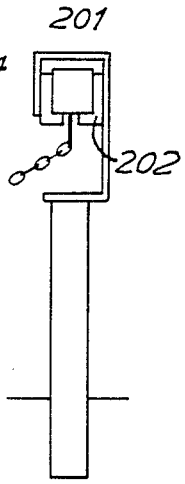
FIG. 12 is an end view of the installation according to FIG. 11.
Figure 13:
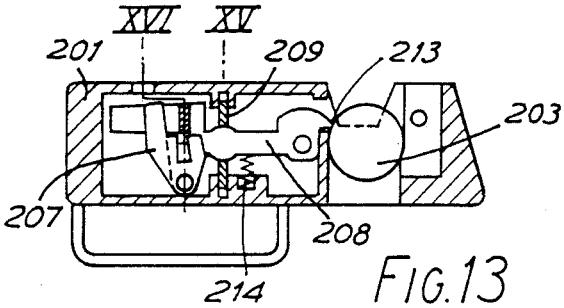
FIG. 13 is a view in longitudinal section, partially in plan view, of a deposit system apparatus locked by a deposit coin.
Figure 14:
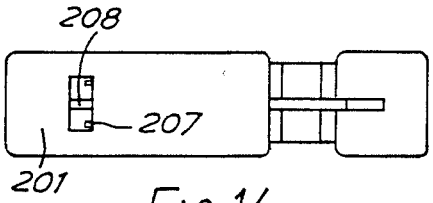
FIG. 14 is a plan view of the apparatus according to FIG. 13.
Figure 15:
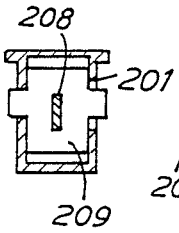
FIGS. 15 and 16 are sectional views along the lines XV and XVI respectively in FIG. 13.
Figure 16:
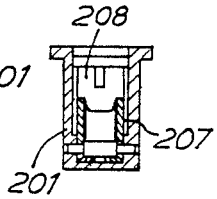
Figure 17:
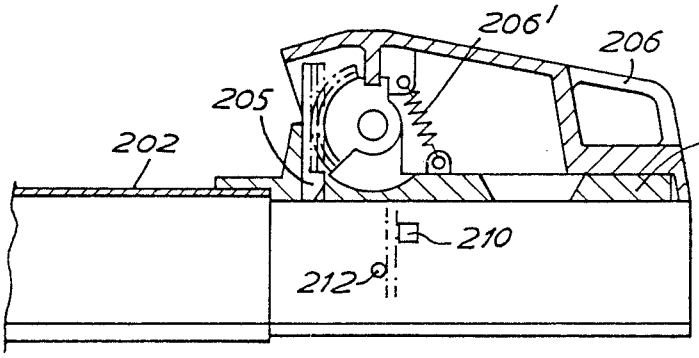
FIG. 17 is a longitudinal sectional view of a station head, empty.
Figure 18:
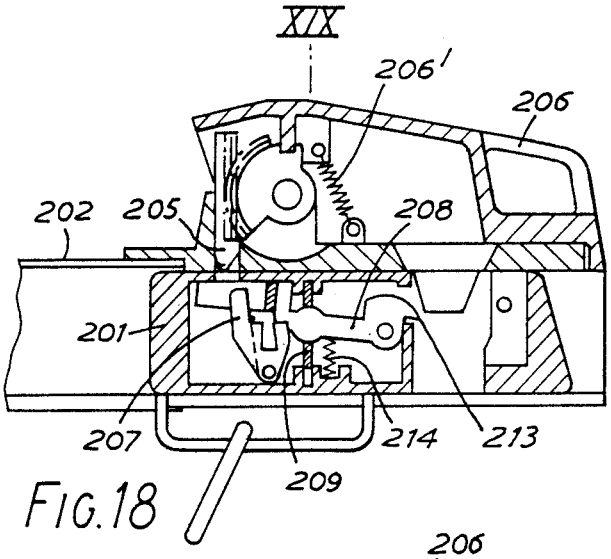
FIG. 18 is analogous with FIG. 17, with an empty deposit system apparatus in abutment.
Figure 19:
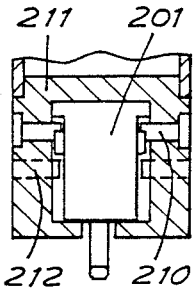
FIG. 19 is a partial sectional view along the line XIX in FIG. 18, the deposit system apparatus being assumed to be full.

The deposit system apparatuses or consignors 201 are held sliding in a C-section bar or rail 202 the opening of which is situated downwards and are connected to the trolleys by chains (see FIG. 11). The coin device is represented in FIGS. 13 to 16 in the position with deposit coin 203 introduced and device withdrawn from the rail 202.

Figure 20:
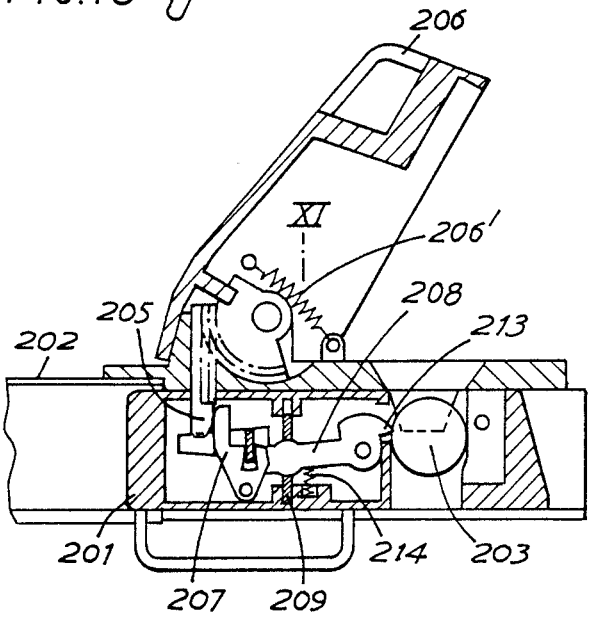
FIG. 20 is analogous with FIG. 18, in the course of the liberation of a deposit coin.
Figure 21:
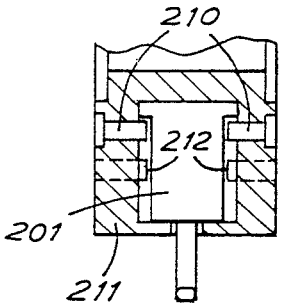
FIG. 21 is analogous with FIG. 19, for the line XXI in FIG. 20.

A station head 204 (FIG. 17) situated in extension of the rail 202 arrests the deposit devices 201. It is equipped with a key 205 which penetrates into the apparatus when a lever is raised which forms a cover 206 (FIGS. 20, 21). In a first action this key aligns tumblers 207 which permit the movement of a feeler 208, likewise thrust by the key 205 and returned by a spring 214, the feeler being displaced into a position such that the coin introduction passage is totally open. The coin 202 introduced will be retained (if it is of the right diameter) within the coin device. If it is too small it falls.

The cover 206 is returned by a traction spring 206'. The feeler 208 being freed, when the key 205 rises again it returns to place itself against the deposit coin 203. A bolt 209 displaced by the feeler 208 is then in a position such that it is capable of passing beneath stops 210 fast with the body 211 of the station head; the apparatus can be withdrawn from the assembly.

The pin tumblers 207, returned by springs, lock the feeler 208 afresh, the nose 213 of which prevents the withdrawal of the deposit coin from the passage. When the trolley is returned to the terminal the deposit device will be introduced into the station head body 211. The parts of the bolt 209 protruding from the deposit device will come into abutment on stops 212 attached to the body 211, in order to permit the positioning of the deposit device in the station head. After the cover 216 has been removed the deposit coin 203 can be withdrawn from the deposit device and when the cover 216 is put down again the feeler 218, in the absence of a deposit coin, will bring the bolt 209 into the high position, that is behind the stops 210 (FIGS. 18, 19) of the station head in order again to prevent the removal of the deposit device (without deposit coin).

It should be noted that the station head stops 210 are removable provided that a special tool provided for this purpose is used, in order to permit rapidly of withdrawing all the deposit devices from the terminal without the need to introduce deposit coins.

We claim:

1. Deposit system installation for transport trolleys, comprising, a locking line constituted by a substantially horizontal bar, deposit system apparatuses, each connected to a trolley, whereby there is cooperation of longitudinal sliding within the line, each deposit apparatus comprising a coin system arranged to permit separation of an apparatus from said locking system by the introduction of a deposit such as a coin into said apparatus, the liberation of the deposit being produced by the passage of said apparatus over a decoding station forming part of the locking line;

wherein the deposit system apparatus comprises a rotor fast with a control knob and with a locking cam, a plurality of pistons returned by springs locking the rotor in cooperation with counter-pistons sliding in a casing of the apparatus, opposite extremities of the counter-pistons being able to cooperate with a profile of the decoding station in order to unlock the rotor;

wherein the rotor comprises at least one longitudinal locking piston arranged to be brought into the unlocking position by the deposit against the action of a spring, the rotation of the unlocked rotor blocking the locking piston which retains the deposit;

wherein the deposit system apparatus slides on a profile bar and passes beneath a decoding head.

2. Installation according to claim 1, wherein the said de-coding head comprises a sliding and pivoting knob which can be engaged by a rotor of the said apparatus controlling a transversely sliding bolt, the sliding of the said knob being possible only when a deposit is present in the said apparatus.

3. Installation according to claim 2, wherein the said knob (124) controls the liberation of the said deposit by a converse rotation.

4. Installation according to claim 1, wherein the said substantially horizontal bar has a C-shaped profile the opening of which is directed downwards, the said deposit apparatuses being connected to the respective trolley by a flexible connection such as a chain and sliding within the said profile with the said flexible connection passing through the said opening.

5. Installation according to claim 4, wherein the de-coding station comprises a lever which in the open position clears an opening within the C-shaped section permitting the introduction and extraction of the deposit coin into and from a deposit device arrested at the said de-coding station.

6. Installation according to claim 5, wherein the said level actuates a key co-operating with a feeler which controls a stop bolt against a fixed abutment lodged within the said C-shaped section.

7. Installation according to claim 6, wherein the said key co-operates with pin tumblers for locking the said feeler.

8. Installation according to claim 7, wherein the said feeler comprises a nose arresting a deposit coin in a coin channel of the deposit apparatus.

* * * * *